United States Patent [19]

Cabral et al.

[11] Patent Number: 4,575,879

[45] Date of Patent: Mar. 18, 1986

[54] SAFETY SEAT CLOSURE

[76] Inventors: Chavelo Cabral, 1144 Brannick, Los Angeles, Calif. 90023; Donald E. Dean, 565 W. 5th St., San Pedro, Calif. 90731; Armando M. Lopez, 4373 Telegraph Rd., Los Angeles, Calif. 90023

[21] Appl. No.: 539,150

[22] Filed: Oct. 5, 1983

[51] Int. Cl.[4] ..... A47K 13/10

[52] U.S. Cl. ..... 4/253

[58] Field of Search ..... 4/248, 251, 253

[56] References Cited

U.S. PATENT DOCUMENTS

| | | | |
|---|---|---|---|
| 1,633,281 | 6/1927 | Nielsen | 4/248 |
| 2,200,687 | 5/1940 | Bercot | 4/251 X |
| 2,578,153 | 12/1951 | Schmitz | 4/253 X |
| 3,316,561 | 5/1967 | Newkirk | 4/251 |
| 3,404,411 | 10/1968 | Newkirk | 4/251 |
| 4,055,864 | 11/1977 | Liu et al. | 4/253 |

*Primary Examiner*—Charles E. Phillips

[57] ABSTRACT

This safety seat closure is designed to prevent small children from being injured or killed, when using toilet commodes. Primarily, the closure consists of a base member with a cover, and a pair of shafts in the structure are secured to two pair of lever arms, which are secured to the seat and lid of the commode. The structure further includes interior mechanisms for locking the lid and seat closed, and also unlocking the seat and lid from their closed positions.

1 Claim, 7 Drawing Figures

FIG. 1
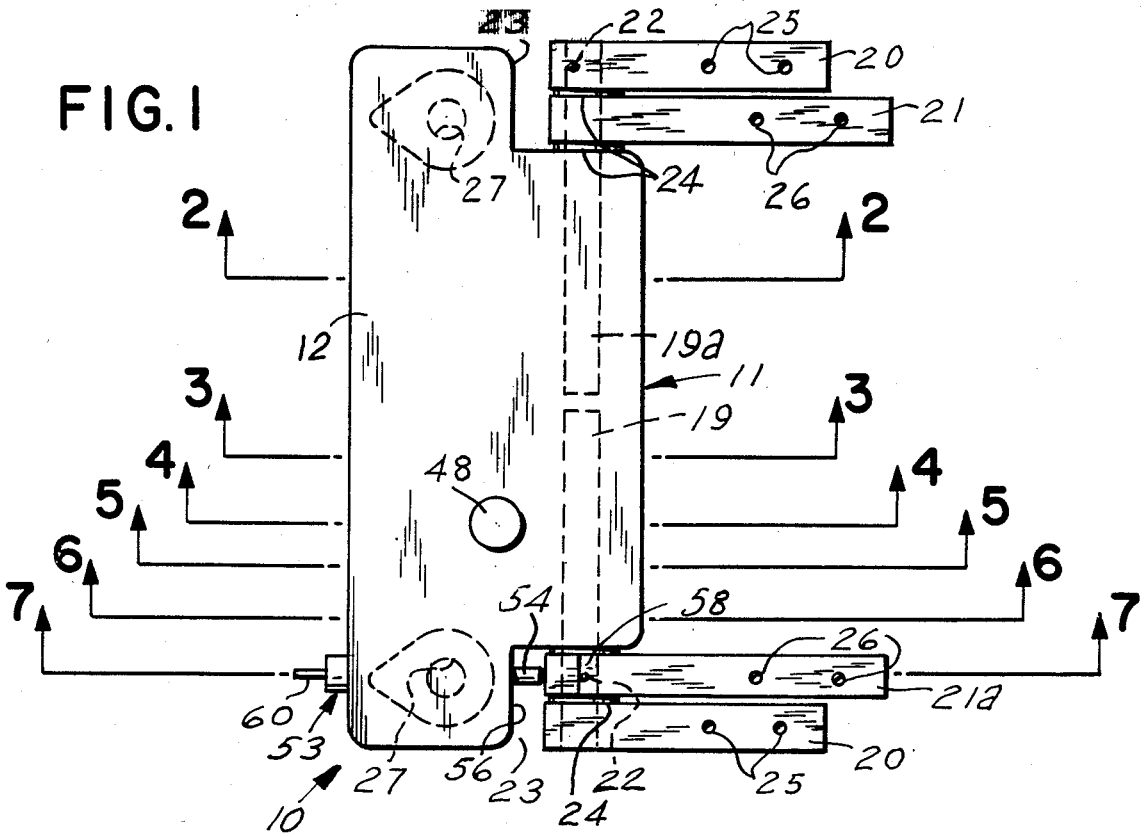
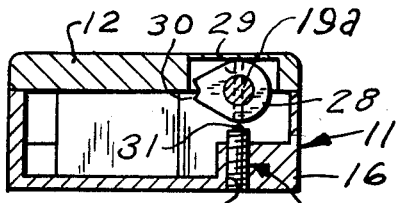
FIG. 2
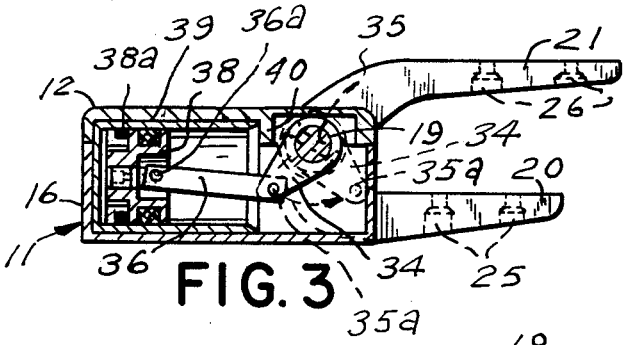
FIG. 3
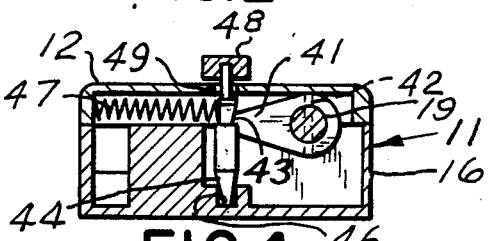
FIG. 4
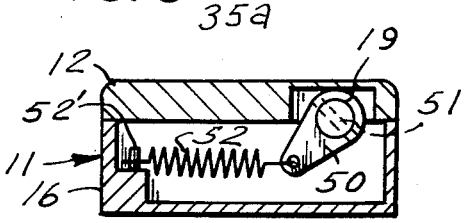
FIG. 5
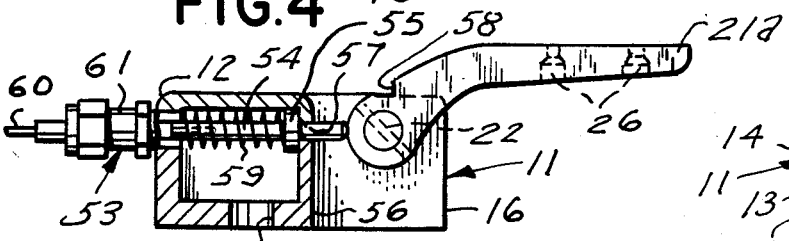
FIG. 7
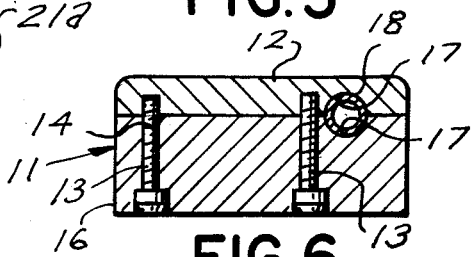
FIG. 6

SAFETY SEAT CLOSURE

This invention relates to devices for toilet commodes, and more particularly, to a safety seat closure.

The principal object of this invention is to provide a safety seat closure, which will be employed to prevent accidents and the death of small infants, which has been a problem that has largely been overlooked in the past, and which has been substantiated in part, by the United States Consumer Products Commissioner.

Another object of this invention is to provide a safety seat closure, which will be of such design, that it will child-proof a toilet commode, by automatically closing the seat and lid after the toilet's use, and locking the lid closed.

Another object of this invention is to provide a safety seat closure, which will require two hands and two movements to lift the lid.

A further object of this invention is to provide a safety seat closure, which will employ a soft close or cushioned closer, that will be incorporated for both the seat and the lid.

A still further object of this invention is to provide a safety seat enclosure, which will be of such design, as to enable the seat and/or lid to stay in the upward condition until the toilet is flushed, at which time, the lid and seat will slowly close and lock in the closed position.

Other objects are to provide a safety seat closure, which is simple in design, inexpensive to manufacture, rugged in construction, easy to use, and efficient in operation.

These, and other objects, will be readily evident, upon a study of the following specification, and the accompanying drawing, wherein:

FIG. 1 is a top plan view of the present invention, showing the lid and seat removed therefrom;

FIG. 2 is a cross-sectional view, taken along the line 2—2 of FIG. 1;

FIG. 3 is a cross-sectional view, taken along the line 3—3 of FIG. 1;

FIG. 4 is a cross-sectional view, taken along the line 4—4 of FIG. 1;

FIG. 5 is a cross-sectional view, taken along the line 5—5 of FIG. 1;

FIG. 6 is a cross-sectional view, taken along the line 6—6 of FIG. 1, and FIG. 7 is a cross-sectional view, taken along the line 7—7 of FIG. 1.

Accordingly, a seat closure 10 is shown to include a housing 11, having a cover 12 secured thereto, by means of suitable bolt fasteners 13, which are threadingly received within threaded openings 14 in the underside of cover 12, and are freely received within non-threaded openings 15 through the base member 16 of housing 11. A semi-circular opening 17, in both cover 12 and base member 16, receives bushings 18, in which are received a pair of shafts 19 and 19*a*, which are in alignment with each other on their longitudinal axes, and a plurality of lever arms 20, 21, and 21*a* are fixedly secured to the ends of shafts 19 and 19*a*, by means of transverse clevis pins 22. Arms 20, 21, and 21*a* are pivotally received within the cut-out areas 23 provided on the ends of housing 11, and spacers 24 are provided on shafts 20 and 21, between each, and against the outside of housing 11, for freedom of movement thereof. Lever arms 20 comprise the seat arms, and levers 21 and 21*a* comprise the lid arms, the lid and seat not being shown.

Lever arms 20 are provided with a pair of openings 25, for receiving screw fasteners, not shown, for securing arms 20 to the toilet seat, and lever arms 21 and 21*a*, include similar openings 26, for receiving screw fasteners, not shown, for securing arms 21 and 21*a* to the lid of the toilet. Housing 11 is suitably secured to the top rear of the toilet or commode, by fastners (not shown), which are received in the openings 27 provided in the bottom of base member 16. A detent cam 28 is fixedly secured to shaft 19*a*, by a transverse pin 29 on the interior of cover 12 and base member 16, and a groove 30 on the end of detent cam 28 serves to engage with the spring-loaded ball 31 of a common cylindrical detent assembly 32, which is threaded into opening 33 through the bottom of base member 16. The detent cam 28 and its associated detent assembly 32 serve to hold the toilet seat in its open condition, by the ball 31 means of detent assembly 32.

Looking now at FIG. 3, a crank arm 34 is fixedly secured to shaft 19, by a clevis pin 35 at one end, and its opposite end is pivotally secured to one end of a piston rod 36 by pin 35*a*. The opposite end of piston rod 36 is pivotally secured, by pin 36*a*, to the interior of a piston 38, which is slideable within a cylinder 39, which is suitably secured within base member 16, and held from movement by a rib 40, which is integrally attached to the under side of cover 12. The piston 38 includes an "O"-ring 38*a* within its outer periphery, for sealing against the bore of cylinder 39, and the piston 38 and rod 36 combination serves to control the closure rate of the seat or lid, to a soft gradual closing.

Referring now to FIG. 4 of the drawing, a lid locking arm 41 is fixedly secured to shaft 19, by means of transverse pin 42, and the opposite end of locking arm 41 is engageable with the recessed portion 43 of the stem 44 of lid button 48. The tapered bottom end of stem 44 is freely received within a recessed opening 46 in the bottom of base member 16, and one end of a coil spring 47 is suitably secured to the upper portion of stem 44. The opposite end of spring 47 is fixedly secured, in a suitable manner, to one side surface of the interior of cover 12. The upper end of stem 44 includes a lid button 48, which is fixedly secured thereto, and is external of the top of cover 12, and the upper portion of stem 44 is freely received within an opening 49 through cover 12. The lid button 48 is pushed rearward, while the lid of the toilet is lifted, which disengages the stem 44 from arm 41 attached to shaft 19, so as to enable the lid of the toilet to be lifted and held in open condition by the plunger assembly 53 (see FIG. 7), in cooperation with detent cam 58 (see FIG. 7).

Referring now to FIG. 5, an arm 50 is fixedly secured to shaft 19, by a transverse pin 51 at one end, and the opposite end is secured to one end of a coil spring 52. The opposite end of spring 52 is secured to a pin 52, which is fixedly secured within an opening in base member 16, which is not shown, and spring 52 serves as return means for arm 50, and it shall also be noted, that spring 47 serves as return means for the upright position of stem 44 of the button 48, as illustrated in FIG. 4 of the drawing. The spring 52 of arm 50, and its connected shaft 19, serve to close the toilet lid upon completion of toilet use.

Referring to FIG. 7, a plunger assembly 53 is provided, which includes a lock pin 54, which has a flange 55, that engages with wall portion 56 of base 16 within a cut-out opening 23. Pin 54 is freely received within opening 57 of base member 16, and its front end engages with the arcuate outer surface of arm 21*a*, which includes a detent notch 58 therein, for engagement with pin 54. A coil spring 59 is received on pin 54, and one end engages with flange 55, while the opposite end engages with the rear wall portion of base member 16. Pin 54 is fixedly secured, at its opposite end, to a trip wire 60, which extends through coupling 61 of assembly 53. The opposite end of trip wire 60 is suitably secured to the free end of the flush arm of the toilet, which is not shown. The plunger assembly 53 serves to hold the seat and lid in open condition, and it shall also be noted, that the mechanisms of FIGS. 2, 3, 4, 5, and 7, are not shown in FIG. 1, for the sake of clarity.

In use, closure 10 is secured to the rear top of a toilet or commode by suitable fasteners received in openings 27, and the trip wire 60, of plunger assembly 53, is suitably secured to the free end of the flush arm of the commode. When it is desired to lift the lid of the commode, the button 48 is pushed back by the user's finger, while the lid is lifted, and when the abovementioned occurs, locking arm 42 disengages from the recessed portion 43 of the stem 44. Upon positioning in the open position, the lock pin 54 engages with the detent notch 58 in the arm 21*a*, and with the lid open, the seat may be lifted by the user, which will be held in the open condition by the detent ball 31 of detent assembly 32, engaging groove 30 of detent cam 28.

Upon completion of the toilet use, the flush arm on the toilet will pull the trip wire, which causes lock pin 54 to release arm 21*a*, which releases the lid, and spring 52 will close the lid. The piston 38 of cylinder 39 forces the entrapped air therein over the orifice, assuring a smooth controlled rate of closure, and the seat closure 10 is controlled by an identical piston arm mechanism, not shown.

For free and fast opening of the seat or lid, the "O"-ring 38*a* rolls back, opening a large bypass air path. Closing off this air path, forces all entrapped air to flow through the restriction orifice, and this is what controls the closure 10 rate to a soft close.

It shall further be recognized, that the seat may be closed by a light push with the hand, or by contact from the lid, when the trip wire 60 is pulled or pushed by hand. When the lid reaches the closed condition, the lid lock button latch or arm 41 engages the recessed portion 43 of stem 44, thus locking the lid in the closed condition.

While various changes may be made in the detail construction, it is understood that such changes will be within the spirit and scope of the present invention, as is defined by the appended claims.

What we now claim is:

1. A safety seat closure for a toilet commode, comprising, in combination, a hollow housing for being mounted on top a rear portion of said toilet commode, a lid on a top of said housing, a pair of aligned shafts supported between said housing and said lid, one end of each said shaft protruding outward from opposit sides of said housing, a pair of lever arms affixed to each said shaft protruding end, a first arm of said pair being attached to a toilet seat and a second of said pair being attached to a seat lid; an interior on a first of said shafts engaging a detent to hold said seat in opened position, a crank on a second of said shafts being attached to a piston rod of a piston in air an bleed cylinder for damping a speed to pivot said seat or lid toward a closed position, an interior locking arm on said second shaft bearing against a spring-biased stem of an externally extending button when locking said lid in closed position, means to manually push said button rearwardly to unlock said lid, an interior arm on said second shaft attached to a tension coiled return spring to move said lid to a closed position, and a plunger assembly in said housing, comprising a spring-biased lock pin, one end of said lock pin being attached to an exterior trip wire connected to a flush arm of a toilet water tank or the like, and an opposite end of said lock pin bearing against a rounded pivot end of one of said second lever arms attached to said seat lid, and a notch along said rounded end being engaged by said lock pin opposite end when said seat is lifted.

* * * * *